US007371160B1

(12) United States Patent
Cruz et al.

(10) Patent No.: US 7,371,160 B1
(45) Date of Patent: May 13, 2008

(54) ELASTOMER-MODIFIED CHEMICAL MECHANICAL POLISHING PAD

(75) Inventors: Carlos A. Cruz, Holland, PA (US); David B. James, Newark, DE (US); Mary Jo Kulp, Newark, DE (US)

(73) Assignee: Rohm and Haas Electronic Materials CMP Holdings Inc., Newark, DE (US)

( * ) Notice: Subject to any disclaimer, the term of this patent is extended or adjusted under 35 U.S.C. 154(b) by 0 days.

(21) Appl. No.: 11/644,478

(22) Filed: Dec. 21, 2006

(51) Int. Cl.
*B24B 11/00* (2006.01)

(52) U.S. Cl. ..... 451/526; 51/307

(58) Field of Classification Search ..... 451/526, 451/533; 51/297, 305, 307
See application file for complete search history.

(56) References Cited

U.S. PATENT DOCUMENTS

| | | | | |
|---|---|---|---|---|
| 5,578,362 | A | 11/1996 | Reinhardt et al. | |
| 5,900,164 | A | 5/1999 | Budinger et al. | |
| 6,022,268 | A | 2/2000 | Roberts et al. | |
| 6,051,314 | A * | 4/2000 | Girgis | 428/375 |
| 6,362,107 | B1 | 3/2002 | Shiro et al. | |
| 6,439,989 | B1 | 8/2002 | Reinhardt et al. | |
| 6,645,264 | B2 | 11/2003 | Hasegawa et al. | |
| 6,705,934 | B1 | 3/2004 | Shiro et al. | |
| 6,860,802 | B1 | 3/2005 | Vishwanathan et al. | |
| 6,998,166 | B2 * | 2/2006 | Prasad | 428/141 |
| 7,029,747 | B2 | 4/2006 | Huh et al. | |
| 7,074,115 | B2 | 7/2006 | James et al. | |
| 7,169,030 | B1 | 1/2007 | Kulp | |
| 2002/0004357 | A1 * | 1/2002 | Baker et al. | 451/41 |
| 2004/0053007 | A1 | 3/2004 | Huh et al. | |
| 2006/0084365 | A1 | 4/2006 | Sakurai et al. | |
| 2006/0125133 | A1 | 6/2006 | Huh et al. | |

OTHER PUBLICATIONS

Polyurethane Handbook, edited by Gunter Oertel, contributions from L. Abele et al. 2nd Edition, Hanser Gardner Publications, Inc. Cincinnati, OH, 1993, pp. 37-47.
Chemical-Mechanical Planarization of Semiconductor Materials, edited by M. R. Oliver, Springer, New York, NY, 2004, pp. 180-182.

* cited by examiner

*Primary Examiner*—Eileen P. Morgan
(74) *Attorney, Agent, or Firm*—Blake T. Biederman

(57) ABSTRACT

The chemical mechanical polishing pad is suitable for polishing at least one of semiconductor, optical and magnetic substrates. The polishing pad includes a polymeric matrix with an elastomeric polymer distributed within the polymeric matrix. The polymeric matrix has a glass transition above room temperature; and the elastomeric polymer has an average length of at least 0.1 μm in at least one direction, represents 1 to 45 volume percent of polishing pad and has a glass transition temperature below room temperature. The polishing pad has an increased diamond conditioner cut rate in comparison to a polishing pad formed from the polymeric matrix without the elastomeric polymer.

6 Claims, 7 Drawing Sheets

Figure 1: Preferred DMA Behavior

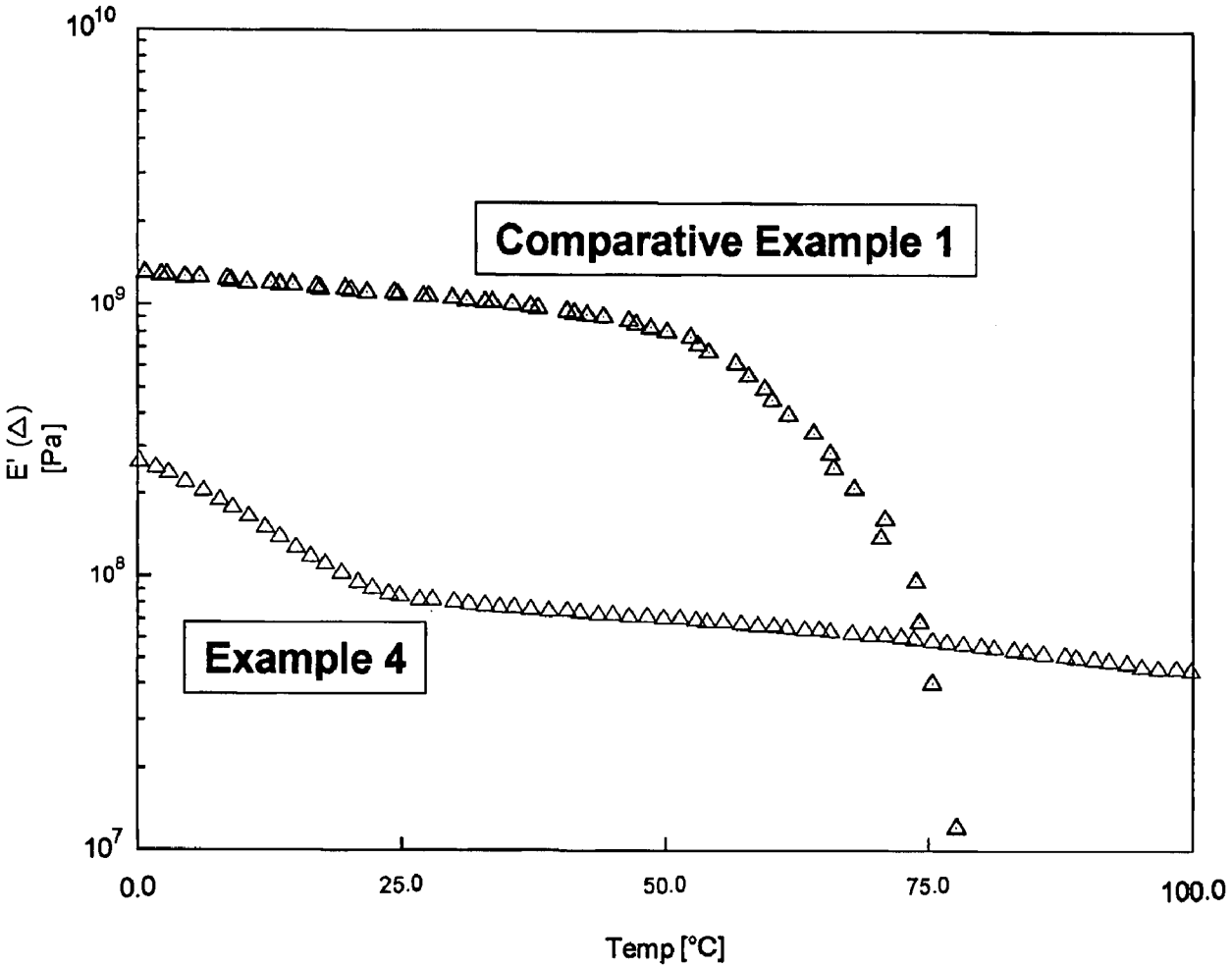
Figure 7: DMA data for Comparative Example 1 versus Example 4.

ELASTOMER-MODIFIED CHEMICAL MECHANICAL POLISHING PAD

BACKGROUND OF THE INVENTION

This specification relates to polishing pads useful for polishing and planarizing substrates, such as semiconductor substrates or magnetic disks.

Polymeric polishing pads, such as polyurethane, polyamide, polybutadiene and polyolefin polishing pads represent commercially available materials for substrate planarization in the rapidly evolving electronics industry. Electronics industry substrates requiring planarization include silicon wafers, patterned wafers, flat panel displays and magnetic storage disks. In addition to planarization, it is essential that the polishing pad not introduce excessive numbers of defects, such as scratches or other wafer non-uniformities. Furthermore, the continued advancement of the electronics industry is placing greater demands on the planarization and defectivity capabilities of polishing pads.

For example, the production of semiconductors typically involves several chemical mechanical planarization (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased numbers of metallization levels. These increasingly stringent device design requirements are driving the adoption of smaller and smaller line spacing with a corresponding increase in pattern density. The devices' smaller scale and increased complexity have led to greater demands on CMP consumables, such as polishing pads and polishing solutions. In addition, as integrated circuits' feature sizes decrease, CMP-induced defectivity, such as, scratching becomes a greater issue. Furthermore, integrated circuits' decreasing film thickness requires improvements in defectivity while simultaneously providing acceptable topography to a wafer substrate; these topography requirements demand increasingly stringent planarity, line dishing and small feature array erosion polishing specifications.

For several years, polyurethane polishing pads, such as the IC1000™ polishing pad from Rohm and Haas Electronic Materials CMP Technologies have provided excellent planarization of patterned semiconductor wafers, but the polymeric microballoons are difficult to disperse uniformly and have a broad particle size distribution. These polishing pads have polyurethanes matrices that contain hard and soft segments. Chemically, the soft segments comprise the high molecular weight long chain glycol component of the formulation. Commonly used glycols include polyether glycols (such as polytetramethylene glycol or polypropylene glycol), or polyester glycols (such as poly ethylene adipate glycol). The mobility of molecular chains in the soft segment, which depends on their chemical nature and chain length, results in increased flexibility, toughness and impact resistance. Phase separation increases with increasing chain length and decreasing polarity of the soft segment due to less hard segment/soft segment interaction. Preferred molecular weights are in the 1,000 to 4,000 range. At higher molecular weights, especially at low hard segment amounts, there is a tendency for the soft segments to crystallize that reduces the elastomeric benefits conferred by the soft segments. Soft segments alternate with hard segments that are stiff oliourethane units, principally composed of reacted isocyanate and chain extender moieties. Hard segments act as pseudo cross-links and control the dimensional thermal stability of polyurethanes. Thus, hard segments control properties such as strength and stiffness at elevated temperatures.

The high molecular weight long chain glycols terminate with reactive groups that react with isocyanates to form urethane linkages. Therefore, since the glycols become an integral part of the polyurethane molecular structure and, as such, this limits their ability to phase separate into large discrete domains. Thus, the glycol chains become the connective links between the hard segments rather than existing as well-defined phase domains. As illustrated in the Polyurethane Handbook, $2^{nd}$ Edition, Edited by Oertel, on page 40, hard and soft domains are intimately mixed at length scales of less than 100 nm. Although these hard and soft domains can provide excellent polishing properties, their scale is too small to impact large-scale-morphology-related properties.

Polyurethane alternative pads, such as polybutadiene pads containing cyclodextrin particles disclosed in U.S. Pat. No. 6,645,264, to Hasegawa et al., have achieved limited commercial applicability. Since Hasegawa et al. introduce the solid cyclodextrin particles by conventional milling techniques, however, it is difficult to achieve a good dispersion having uniform particle size; and agglomeration is a problem.

Huh et al., in U.S. Pat. No. 7,029,747, disclose a polishing pad that includes a liquid mineral phase distributed in a polyurethane matrix. Although the mineral oil is added as a liquid and fairly easy to disperse uniformly, it remains as a liquid phase in the final pad, can leach from the pad during polishing and can contaminate the polished wafer surface.

Shiro et al., in U.S. Pat. No. 6,362,107, disclose polyurethane pads impregnated with acrylate monomers polymerized as a second discrete manufacturing step. The disadvantages of this process is the complex, multi-step sequential manufacturing process involving first polyurethane foam formation, impregnation with an acrylic monomer, followed by subsequent free radical polymerization of the monomer.

There is an ongoing need for improved polishing pads that have superior planarization ability in combination with improved defectivity performance for a variety of electronic applications. Additionally, in order to ensure high wafer throughput, high removal rates and short pad break-in times are required. Furthermore, as semiconductor manufacturing move to increasing temperatures, there is a greater desire for polishing pads with stable polishing performance at high temperatures and over a greater temperature range. Finally, these polishing pads all require manufacturability, pad-to-pad consistency and within pad uniformity.

STATEMENT OF THE INVENTION

An aspect of the invention provides a chemical mechanical polishing pad suitable for polishing at least one of semiconductor, optical and magnetic substrates, the polishing pad comprising a polymeric matrix with an elastomeric polymer distributed within the polymeric matrix, the polymeric matrix having a glass transition above room temperature and the elastomeric polymer having an average length of at least 0.1 μm in at least one direction, the elastomeric polymer representing 1 to 45 volume percent of polishing pad and the elastic polymer having a glass transition temperature below room temperature, and the polishing pad having an increased diamond conditioner cut rate in comparison to a polishing pad formed from the polymeric matrix without the elastomeric polymer.

Another aspect of the invention provides a method of forming a polishing pad suitable for polishing at least one of semiconductor, optical and magnetic substrates, including the following: dispersing a liquid elastomeric polymer or liquid polymerizable monomer within a liquid polymeric precursor; gelling the liquid elastomeric polymer or liquid polymerizable monomer within the liquid polymeric precursor; and forming solid elastomeric polymer within a solid polymeric matrix, the elastomeric polymer having a glass transition temperature below room temperature and the polymeric matrix having a glass transition temperature above room temperature.

BRIEF DESCRIPTION OF THE DRAWINGS

FIG. 7 represents a plot of DMA data of Example 4 versus Comparative Example 1.

DETAILED DESCRIPTION OF THE INVENTION

The present invention involves the addition of a liquid elastomeric polymer (or liquid polymerizable monomer) to one or more polymeric precursors, such that the polymer or polymerizable monomer is initially miscible or at least forms a stable dispersion in the polymeric precursor. For the purposes of this invention an elastomer is defined as an amorphous polymer having a glass transition temperature below room temperature with the ability to regain shape after deformation. During polymerization of the polyurethane precursors, the liquid polymer phase separates to form discrete solid elastomeric domains within the polymeric matrix. Likewise, in the case of the polymerizable monomer, this rapidly polymerizes and then immediately phase separates simultaneously with the formation of the polymeric matrix. By judicious selection of the added liquid elastomeric polymer and the polymeric matrix, by controlling the ratio of the added polymer to the polymeric matrix, or by controlling the polymerization rate, it is possible to control both pad properties over wide ranges and also the domain size of a phase separated elastomeric polymer. The latter can result in the pad having inherent texture that may reduce the need for diamond conditioning before (pad break-in) or during polishing. In addition, the added elastomeric polymer preferably contains some chemical functionality that will enable it to form linkages with a polymeric matrix, such as a polyurethane matrix.

The liquid elastomeric polymer should be more hydrophobic than the liquid polymeric matrix (such as, polyether or polyester glycols), but not so hydrophobic that is forms unstable dispersions with the polymeric matrix precursors, especially the polyol components for polyurethane precursors. Examples of a preferred elastomeric polymer are a copolymer of butadiene with a polar comonomer such as acrylonitrile. By controlling the ratio of butadiene to acrylonitrile the hydrophobicity of the polymer backbone can be optimized to ensure the desired phase separation behavior. Optionally, the liquid elastomeric polymer also contains functional groups capable of reacting with a polymeric precursor, such as isocyanates. Examples of functional groups include hydroxyl, amine and carboxylic acid moieties. The functional groups may be end-groups or spaced along the polymer chain.

The liquid elastomeric polymer should have a molecular weight high enough to achieve elastomeric behavior, but not so high that dispersibility becomes a problem. A preferred molecular weight range is 1,000 to 50,000, most preferably 2,000 to 10,000. For purposes of this specification molecular weight represents weight average molecular weight determined by gel permeation chromatography.

Figure 1:
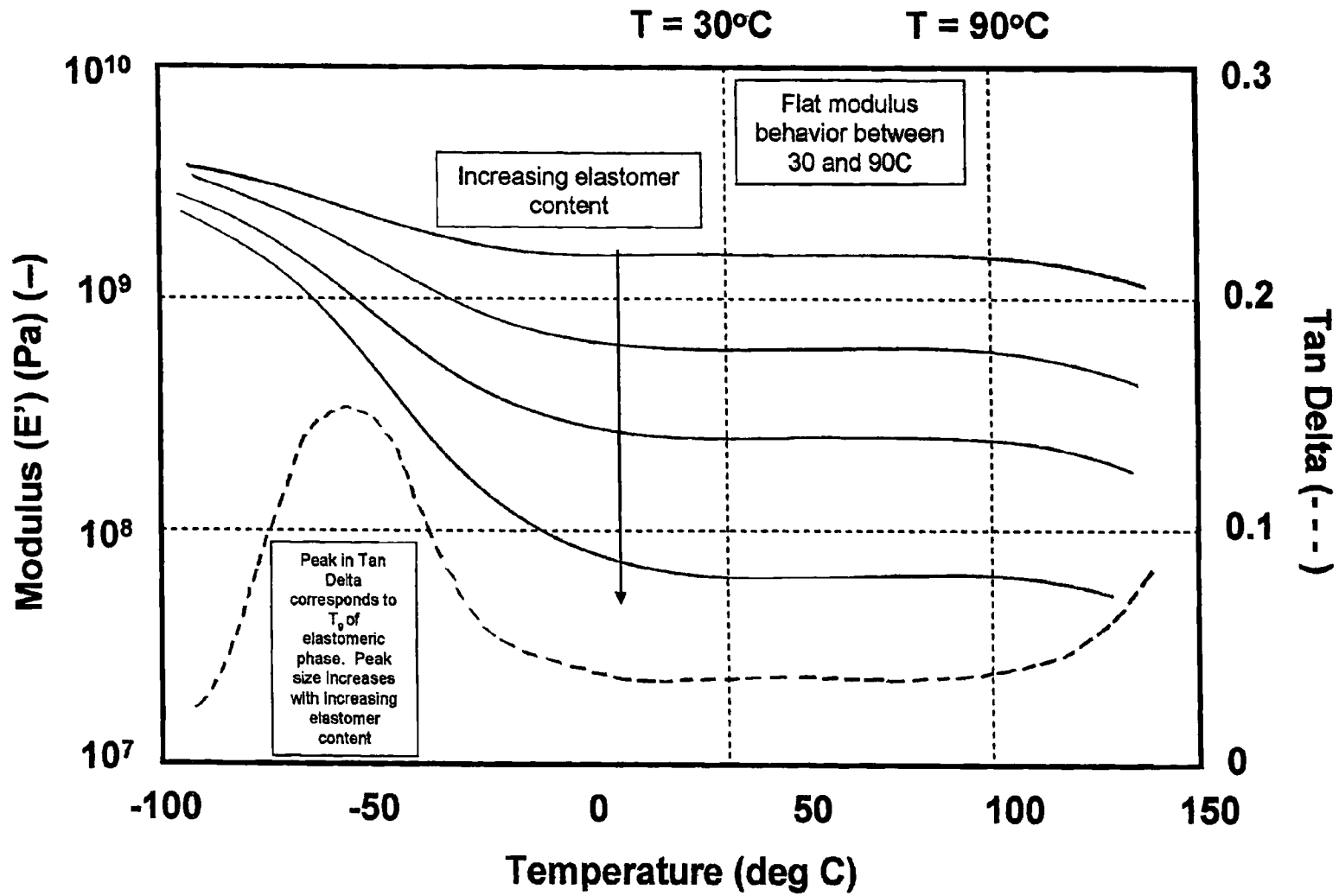
FIG. 1 illustrates preferred DMA modulus and tan delta curves for elastomer-modified polishing pads.

The liquid elastomeric polymer formed should be amorphous and preferably has a glass transition temperature below room temperature, preferably less than −20° C. and most preferably less than −40° C. For purpose of this specification, glass transition temperature represents the temperature at which the polymer transitions from a glassy to a rubbery solid. A convenient method of determining the glass transition temperature is from the temperature of the tan delta peak as measured by dynamic mechanical analysis, as shown in FIG. 1. In addition, the concentration of liquid elastomeric polymer should be in the range 1 to 45 vol. % with respect to the polymeric matrix, preferably 2 to 40 vol. % and most preferably 5 to 35 vol. %. The balance of the polymer will typically be polymeric matrix, but it may also include fillers, such as hollow polymeric spheres, abrasive particles or water-soluble particles.

Examples of suitable liquid elastomeric polymers include the Hycar® family of polymers from Emerald Performance Materials. These are 100% solids liquid rubbers of either butadiene-acrylonitrile copolymers or butadiene homopolymers with glass transition temperatures as low as −77° C. The polymers have functional end groups including carboxyl, amine and epoxy that facilitate in situ formation of the elastomeric polymer. In particular, the functional group bonds with the polymeric matrix to secure the elastomer polymer. Other possible polymers are Polybd® resins from Sartomer. These are hydroxyl-terminated polybutadiene homopolymers. A third preferred elastomeric additive is Paraloid™ TS-7300 Liquid Rubber from Rohm and Haas. "Paraloid" is a trademark registered to Rohm and Haas Company and its affiliates. This is a functionized acrylate copolymer, existing as a viscous liquid at room temperature with a glass transition temperature of −56° C. Typical examples of liquid elastomeric polymers would include at least one selected from polymers and copolymers derived from butadiene, acrylate, methacrylate, siloxane, or olefinic backbones.

The elastomeric liquid polymer is added to the first stream of the reaction injection molding process, namely the diol stream for polyurethanes. This disperses the liquid polymeric elastomer within the polymeric matrix. After or during the dispersion process, the elastomeric liquid polymer or elastomeric liquid polymer formed from liquid polymerizable monomer gels within the liquid polymeric matrix. After or during the gelling of the elastomeric polymer, the gelled elastomeric polymer and liquid polymeric matrix cure to form a solid elastomeric polymer within a solid polymeric matrix. Alternatively, it is possible to introduce the elastomeric particles directly as a solid or as a solid within a shell structure.

The polishing pad of the present invention will contain an elastomeric rubbery phase and a non-elastomeric rigid matrix phase. The length of the elastomeric phase domains will be at least 0.1 μm as measured in at least one direction, such as length or width. Typically, the length of the elastomeric rubbery phase will be between 0.1 and 100 μm as measured in at least one direction. Preferably the length is between 0.15 and 100 μm as measured in at least one direction and most preferably between 0.5 and 50 μm as measured in at least one direction. These domains advantageously are uniformly dispersed throughout the polyurethane matrix and will have approximately spherical geometry. In the final pad, the elastomeric domains are solid and may optionally be cross-linked. Young's modulus of the elastomeric domains will be between 0.1 and 100 MPa, preferably between 1 and 50 MPa, and most preferably between 5 and 10 MPa. Because it is often difficult to measure the modulus of impact modifiers, for purposes of this specification, determining the difference in modulus of the two components is a three step process. The first step involves determining the bulk modulus of the matrix component, such as through ASTM D5418 or D412. Then the next step is to determine the bulk modulus of the final material containing the impact modifiers—this represents an ungrooved sample. Finally, solving the following equation calculates modulus of the impact modifier.

$$E'_{Final}=E'_{Matrix}*\text{Vol.}\%_{Matrix}+E'_{ImpactModifier}*\text{Vol.}\%_{ImpactModifier}$$

Hardness of the elastomeric domains are typically well below that of the matrix polymer. The concentration of elastomeric domains in the polyurethane matrix will be between 1 and 45 vol. %, exclusive of additional non-elastomeric fillers, preferably between 2 and 40 vol. %, exclusive of additional non-elastomeric fillers and most preferably between 5 and 35 vol. %, exclusive of additional non-elastomeric fillers. The overall bulk physical properties of the pad will be a Young's tensile modulus between 50 and 2000 MPa, a Shore D hardness between 20 and 80D, preferably between 40 and 60D, and an elongation to break between 50 and 400%.

Optionally, the polishing pads of the present invention may also include other plastics additives, including: waxes; pigments; opacifiers; fillers; exfoliated clays; toners; antistatic agents; metals; flame retardants; thermal stabilizers; co-stabilizers; antioxidants; cellulosic materials; other impact modifiers; processing aids; lubricating processing aids; internal lubricants; external lubricants; oils; rheology modifiers; powder flow aids; melt-flow aids; dispersing aids; UV stabilizers; plasticizers; fillers; optical modifiers; surface roughness modifiers; surface chemistry modifiers; adhesion modifiers; surface hardeners; compatibilizers; diffusion barrier modifiers; stiffeners; flexibilizers; mold release agents; processing modifiers; blowing agents; thermal insulators; thermal conductors; electronic insulators; electronic conductors; biodegradation agents; antistatic agents; internal release agents; coupling agents; flame retardants; smoke-suppressers; anti-drip agents; colorants; and combinations thereof. These optional plastics additives can be subsequently added by various powder processes such as: powder post-blending; co-spray drying; and co-agglomeration. In addition, it is possible to introduce additional structure into the polishing pad to further adjust polishing performance, such as, hollow polymeric microspheres, water soluble particles, abrasive particles and fibers.

The elastomer-modified structure can be visualized through microscopy such as electron microscopy, including transmission or scanning tapping mode scanning probe microscopy. The preferred method for determining volume fractions impact modifiers and matrix material will vary with the polymer system evaluated.

Typical polymeric polishing pad materials include polycarbonate, polysulphone, nylon, ethylene copolymers, polyethers, polyesters, polyether-polyester copolymers, acrylic polymers, polymethyl methacrylate, polyvinyl chloride, polycarbonate, polyethylene copolymers, polybutadiene, polyethylene imine, polyurethanes, polyether sulfone, polyether imide, polyketones, epoxies, silicones, copolymers thereof and mixtures thereof. Preferably, the polymeric material is a polyurethane. For purposes of this specification, "polyurethanes" are products derived from difunctional or polyfunctional isocyanates, e.g. polyetherureas, polyisocyanurates, polyurethanes, polyureas, polyurethaneureas, copolymers thereof and mixtures thereof.

Cast polyurethane polishing pads are suitable for planarizing semiconductor, optical and magnetic substrates. The polyurethane matrix can be thermoplastic (uncrosslinked) or preferably thermosetting (crosslinked). The pads' particular polishing properties arise in part from a prepolymer reaction product of a prepolymer polyol and a polyfunctional isocyanate. The prepolymer product is cured with a curative agent selected from the group comprising curative polyamines, curative polyols, curative alcohol amines and mixtures thereof to form a polishing pad. The polyurethane matrix should be non-elastomeric at room temperature such that the softening point of the polyurethane matrix should be above room temperature, preferably above 75° C. and most preferably above 110° C.

Although the polyurethane matrix of this invention may be formed from long-chain polyether and polyester glycols typically used in polyurethane formation, to realize the benefits of the invention it is necessary to add a long chain, initially liquid, essentially dispersible, elastomeric polymer that will phase separate during polymerization of the polyurethane to form larger, more distinctly discrete phases within the polyurethane matrix. Thus the preferred added polymers will be more hydrophobic than the polyether and polyester glycols used to form the polyurethane backbone.

The polishing pads may optionally contain a porosity concentration of at least 0.1 volume percent. Porosity includes gas-filled particles, gas-filled spheres and voids formed from other means, such as mechanically frothing gas into a viscous system, injecting gas into the polyurethane melt, introducing gas in situ using a chemical reaction with gaseous product, or decreasing pressure to cause dissolved gas to form bubbles. This porosity contributes to the polishing pad's ability to transfer polishing fluids during polishing. Preferably, the polishing pad has a porosity concentration of 0.2 to 70 volume percent. Most preferably, the polishing pad has a porosity concentration of 0.3 to 65 volume percent. Preferably the pores particles have a weight average diameter of 1 to 100 μm. Most preferably, the pores particles have a weight average diameter of 10 to 90 μm. The nominal range of expanded hollow-polymeric microspheres' weight average diameters is 15 to 90 μm. Furthermore, a combination of high porosity with small pore size can have particular benefits in reducing defectivity. For example, a pore size of 2 to 50 μm constituting 25 to 65 volume percent of the polishing layer facilitates a reduction in defectivity.

For several semiconductor wafer polishing applications, non-porous polishing pads provide superior polishing performance. During polishing, continuous or "in situ" conditioning, such as diamond conditioning maintains a consistent polishing pad texture for consistent wafer-to-wafer polishing performance. Alternatively, periodic or "ex situ" diamond conditioning may also improve the polishing pad's performance.

Preferably, the polymeric material is a block or segmented copolymer capable of separating into phases rich in one or more blocks or segments of the copolymer. Most preferably the polymeric material is a polyurethane. An approach for controlling a pad's polishing properties is to alter its chemical composition. In addition, the choice of raw materials and manufacturing process affects the polymer morphology and the final properties of the material used to make polishing pads.

Preferably, urethane production involves the preparation of an isocyanate-terminated urethane prepolymer from a polyfunctional aromatic isocyanate and a prepolymer polyol. For purposes of this specification, the term prepolymer polyol includes diols, polyols, polyol-diols, copolymers thereof and mixtures thereof. Preferably, the prepolymer polyol is selected from the group comprising polytetramethylene ether glycol [PTMEG], polypropylene ether glycol [PPG], ester-based polyols, such as ethylene or butylene adipates, copolymers thereof and mixtures thereof. Example polyfunctional aromatic isocyanates include 2,4-toluene diisocyanate, 2,6-toluene diisocyanate, 4,4'-diphenylmethane diisocyanate, naphthalene-1,5-diisocyanate, tolidine diisocyanate, para-phenylene diisocyanate, xylylene diisocyanate and mixtures thereof. The polyfunctional aromatic isocyanate contains less than 20 weight percent aliphatic isocyanates, such as 4,4'-dicyclohexylmethane diisocyanate, isophorone diisocyanate and cyclohexanediisocyanate. Preferably, the polyfunctional aromatic isocyanate contains less than 15 weight percent aliphatic isocyanates and more preferably, less than 12 weight percent aliphatic isocyanate.

Example prepolymer polyols include polyether polyols, such as, poly(oxytetramethylene)glycol, poly(oxypropylene)glycol and mixtures thereof, polycarbonate polyols, polyester polyols, polycaprolactone polyols and mixtures thereof. Example polyols can be mixed with low molecular weight polyols, including ethylene glycol, 1,2-propylene glycol, 1,3-propylene glycol, 1,2-butanediol, 1,3-butanediol, 2-methyl-1,3-propanediol, 1,4-butanediol, neopentyl glycol, 1,5-pentanediol, 3-methyl-1,5-pentanediol, 1,6-hexanediol, diethylene glycol, dipropylene glycol, tripropylene glycol and mixtures thereof.

Preferably the prepolymer polyol is selected from the group comprising polytetramethylene ether glycol, polyester polyols, polypropylene ether glycols, polycaprolactone polyols, copolymers thereof and mixtures thereof. If the prepolymer polyol is PTMEG, copolymer thereof or a mixture thereof, then the isocyanate-terminated reaction product preferably has a weight percent unreacted NCO range of 8.0 to 20.0 weight percent. For polyurethanes formed with PTMEG or PTMEG blended with PPG, the preferable weight percent NCO is a range of 8.75 to 12.0; and most preferably it is 8.75 to 10.0. Particular examples of PTMEG family polyols are as follows: Terathane® 2900, 2000, 1800, 1400, 1000, 650 and 250 from Invista; Polymeg® 2900, 2000, 1000, 650 from Lyondell; PolyTHF® 650, 1000, 2000 from BASF, and lower molecular weight species such as 1,2-butanediol, 1,3-butanediol, and 1,4-butanediol. If the prepolymer polyol is a PPG, copolymer thereof or a mixture thereof, then the isocyanate-terminated reaction product most preferably has a weight percent unreacted NCO range of 7.9 to 15.0 wt. %. Particular examples of PPG polyols are as follows: Arcol® PPG-425, 725, 1000, 1025, 2000, 2025, 3025 and 4000 from Bayer; Voranol® 1010L, 2000L, and P400 from Dow; Desmophen® 1110BD, Acclaim® Polyol 12200, 8200, 6300, 4200, 2200 both product lines from Bayer If the prepolymer polyol is an ester, copolymer thereof or a mixture thereof, then the isocyanate-terminated reaction product most preferably has a weight percent unreacted NCO range of 6.5 to 13.0. Particular examples of ester polyols are as follows: Millester 1, 11, 2, 23, 132, 231, 272, 4, 5, 510, 51, 7, 8, 9, 10, 16, 253, from Polyurethane Specialties Company, Inc.; Desmophen® 1700, 1800, 2000, 2001KS, 2001K$^2$, 2500, 2501, 2505, 2601, PE65B from Bayer; Rucoflex S-1021-70, S-1043-46, S-1043-55 from Bayer.

Typically, the prepolymer reaction product is reacted or cured with a curative polyol, polyamine, alcohol amine or mixture thereof. For purposes of this specification, polyamines include diamines and other multifunctional amines. Example curative polyamines include aromatic diamines or polyamines, such as, 4,4'-methylene-bis-o-chloroaniline [MBCA], 4,4'-methylene-bis-(3-chloro-2,6-diethylaniline) [MCDEA]; dimethylthiotoluenediamine; trimethyleneglycol di-p-aminobenzoate; polytetramethyleneoxide di-p-aminobenzoate; polytetramethyleneoxide mono-p-aminobenzoate; polypropyleneoxide di-p-aminobenzoate; polypropyleneoxide mono-p-aminobenzoate; 1,2-bis(2-aminophenylthio)ethane; 4,4'-methylene-bis-aniline; diethyltoluenediamine; 5-tert-butyl-2,4- and 3-tert-butyl-2,6-toluenediamine; 5-tert-amyl-2,4- and 3-tert-amyl-2,6-toluenediamine and chlorotoluenediamine. Optionally, it is possible to manufacture urethane polymers for polishing pads with a single mixing step that avoids the use of prepolymers.

The components of the polymer used to make the polishing pad are preferably chosen so that the resulting pad morphology is stable and easily reproducible. For example, when mixing 4,4'-methylene-bis-o-chloroaniline [MBCA] with diisocyanate to form polyurethane polymers, it is often advantageous to control levels of monoamine, diamine and triamine. Controlling the proportion of mono-, di- and triamines contributes to maintaining the chemical ratio and resulting polymer molecular weight within a consistent range. In addition, it is often important to control additives such as anti-oxidizing agents, and impurities such as water for consistent manufacturing. For example, since water reacts with isocyanate to form gaseous carbon dioxide, controlling the water concentration can affect the concentration of carbon dioxide bubbles that form pores in the polymeric matrix. Isocyanate reaction with adventitious water also reduces the available isocyanate for reacting with chain extender, so changes the stoichiometry along with level of crosslinking (if there is an excess of isocyanate groups) and resulting polymer molecular weight.

The polyurethane polymeric material is preferably formed from a prepolymer reaction product of toluene diisocyanate and polytetramethylene ether glycol with an aromatic diamine. Most preferably the aromatic diamine is 4,4'-methylene-bis-o-chloroaniline or 4,4'-methylene-bis-(3-chloro-2,6-diethylaniline). Preferably, the prepolymer reaction product has a 6.5 to 15.0 weight percent unreacted NCO. Examples of suitable prepolymers within this unreacted NCO range include: Airthane® prepolymers PET-70D, PHP-70D, PET-75D, PHP-75D, PPT-75D, PHP-80D manufactured by Air Products and Chemicals, Inc. and Adiprene® prepolymers, LFG740D, LF700D, LF750D, LF751D, LF753D, L325 manufactured by Chemtura. In addition, blends of other prepolymers besides those listed above could be used to reach to appropriate percent unreacted NCO levels as a result of blending. Many of the above-listed prepolymers, such as, LFG740D, LF700D, LF750D, LF751D, and LF753D are low-free isocyanate prepolymers that have less than 0.1 weight percent free TDI monomer and have a more consistent prepolymer molecular weight distribution than conventional prepolymers, and so facilitate forming polishing pads with excellent polishing characteristics. This improved prepolymer molecular weight consistency and low free isocyanate monomer give a more regular polymer structure, and contribute to improved polishing pad consistency. For most prepolymers, the low free isocyanate monomer is preferably below 0.5 weight percent. Furthermore, "conventional" prepolymers that typically have higher levels of reaction (i.e. more than one polyol capped by a diisocyanate on each end) and higher levels of free toluene diisocyanate prepolymer should produce similar results. In addition, low molecular weight polyol additives, such as, diethylene glycol, butanediol and tripropylene glycol facilitate control of the prepolymer reaction product's weight percent unreacted NCO.

In addition to controlling weight percent unreacted NCO, the curative and prepolymer reaction product typically has an OH or $NH_2$ to unreacted NCO stoichiometric ratio of 85 to 115 percent, preferably 90 to 110 percent; and most preferably, it has an OH or $NH_2$ to unreacted NCO stoichiometric ratio of greater than 95 to 109 percent. For example, polyurethanes formed with an unreacted NCO in a range of 101 to 108 percent appear to provide excellent results. This stoichiometry could be achieved either directly, by providing the stoichiometric levels of the raw materials, or indirectly by reacting some of the NCO with water either purposely or by exposure to adventitious moisture.

FIG. 1 shows preferred DMA behavior for a pad composition of this invention. The pad comprises two primary phases. The first is a non-elastomeric high softening polyurethane matrix that does not appreciably lose its modulus or strength until above 110° C. The second is a discrete elastomeric phase having a glass transition temperature below −40° C. As the concentration of the elastomeric phase increases, the overall modulus and hardness of the pad decrease. Thus the pad properties can be optimized for specific polishing applications in order to achieve a desirable balance between removal rate, defectivity and topographical control of the wafer surface. Desirable overall bulk physical properties of the pad will be a Young's tensile modulus between 50 and 2,000 MPa, a Shore D hardness between 20 and 80D, preferably between 30 and 60D, and an elongation to break between 50 and 400%.

Since polishing takes place over a wide temperature range (room temperature to almost 100° C.), it is desirable to have a flat modulus-temperature response. This is conveniently captured by the ratio of modulus measured at 30 and 90° C. A value less than three, preferably less than 2 and ideally as close to unity as possible is preferred for stable polishing performance.

Although this type of DMA behavior can be achieved by controlling the hard-soft segment ratio through the choice of the polyether or polyester diol, as will be shown in the examples below, such diols do not give the preferred texture that is a distinguishing and differentiating feature of this invention.

The low temperature elastomeric phase is preferably formed from a butadiene-acrylonitrile copolymer containing groups that can react with isocyanate. The liquid rubber is mixed with the polydiol stream such that it is miscible or at least forms a stable dispersion. The miscibility or hydrophobicity of the liquid rubber can be adjusted by controlling the ratio of polar to non-polar groups in the backbone of the liquid rubber. For example, in the case of a butadiene-acrylonitrile copolymer, increasing the concentration of the more polar acrylonitrile group will increase miscibility and also reduce the size of the elastomeric domains in the final pad. During polymerization of the polyurethane matrix the liquid rubber phase separates to form discrete rubbery domains. These are larger than the soft-segment domains formed from conventional polyether or polyester diols and impart significant texture to the pad surface and bulk. Thus the pad surface is rougher than the molded surface in the absence of the elastomeric phase. Hence pad break-in time is reduced and polishing performance improved.

An additional benefit of the invention, is that since the elastomeric phase is initially added as liquid, it is more readily dispersible than a solid particle and secondly, as it phase separates into discrete domains during the polyurethane cure, by controlling the rate of that reaction it is possible to control the particle size of the resulting elastomeric domains.

EXAMPLES

All the pads described in the examples were produced by reaction injection molding. Comparative Example 1 is a commercial pad known by the tradename OXP4000™ and the other two comparative examples are developmental pads. Examples 4 and 5 are experimental formulations of the current invention showing benefits over the comparative examples. Example 6 is conceptual and illustrates the formation of a discrete elastomeric phase by the addition of a monomer that on polymerization gives an elastomeric polymer.

Comparative Example 1

This example refers to a prior art pad disclosed in U.S. Pat. Nos. 6,022,268 and 6,860,802 (Pad 2A).

In order to form the polishing pad, two liquid streams were mixed together and injected into a closed mold, having the shape of the required pad. The first stream comprised a mixture of a polymeric diol and a polymeric diamine, together with an amine catalyst. The second stream comprised diphenylmethanediisocyanate (MDI). The amount of diisocyanate used was such as to give a slight excess after complete reaction with diol and diamine groups.

The mixed streams were injected into a heated mold at about 70° C. to form a phase separated polyurethane-urea polymeric material. After the required polymerization time had elapsed, the now solid part, in the form of a net-shape pad, was subsequently demolded.

The composition of the pad and key physical properties are shown in Tables 1 and 2, respectively.

Comparative Example 2

The pad of Comparative Example 2 was made using a process analogous to that used in Example 1. The composition of the pad and key physical properties are again shown in Tables 1 and 2, respectively.

Comparative Example 3

The pad of Comparative Example 3 was made using a process analogous to that used in Example 1. The composition of the pad and key physical properties are again shown in Tables 1 and 2, respectively.

Example 4

Example 4 illustrates making a pad of the present invention containing a liquid elastomer using a process analogous to that used in Example 1. The composition of the pad and key physical properties are again shown in Tables 1 and 2, respectively.

Example 5

Example 5 illustrates making a pad of the present invention containing a liquid elastomer using a process analogous to that used in Example 1. The composition of the pad and key physical properties are again shown in Tables 1 and 2, respectively.

Example 6

This conceptual example demonstrates the potential of adding a liquid monomer that subsequently polymerizes to form a phase separated elastomeric phase within the polyurethane matrix.

Butyl acrylate or a mixture of butyl acrylate and other unsaturated monomers together with a thermally activated free radical catalyst are added to the polyol stream. This stream and the isocyanate stream are then mixed together and injected into a mold. The temperature of the mold is selected such that the acrylate monomers rapidly polymerize ahead of or simultaneously with the polyurethane polymerization to give a phase separated structure comprising an elastomeric phase of polybutylacrylate homopolymer or copolymer dispersed in a polyurethane matrix.

Table 1 summarizes the formulations of Examples 1 to 5.

| | Examples | | | | |
|---|---|---|---|---|---|
| Composition (parts by weight) | 1 | 2 | 3 | 4 | 5 |
| Polytetramethylene glycol (Eq. Wt. 1000) | 22 | — | 40 | 40 | 40 |
| Polypropylene glycol (Eq. Wt. 2100) | — | 10 | — | — | — |
| Polyamine (Eq. Wt. 220) | 44 | 24 | — | — | — |
| Polyamine (Eq. Wt. 425) | — | 35 | — | — | — |
| Ethacure ® 100-LC Curative | — | — | 6 | 6 | 6 |
| Hycar ® RLP ATBNX42 | — | — | — | 4 | 7 |
| MDI (Eq. Wt. 144.5) | 33 | 30 | 33 | 39 | 39 |

Hycar ® Amine Terminated Liquid Polymer ATBNX42 is available from Emerald Performance Materials
Ethacure ® 100-LC is available from Albemarle ® Corporation Table 2 summarizes the physical properties of Examples 1 to 5

| | Examples | | | | |
|---|---|---|---|---|---|
| Pad Physical Properties | 1 | 2 | 3 | 4 | 5 |
| Tensile Modulus (E') at 40 C. (MPa) | 1580 | 690 | 76 | 75 | 67 |
| Ratio of E' at 30 C. and 90 C. | 11.8 | 3.4 | 1.4 | 1.6 | 2.4 |
| KEL (1/Pa) at 40 C. | 33 | 199 | 598 | 1015 | 1260 |
| Hardness (Shore D) | 60-65 | 60 | 37 | 38 | 36 |
| Tensile Strength (MPa) | 42 | — | 28 | 17 | 12 |
| Elongation to Break (%) | 195 | — | 504 | 291 | 173 |
| Cut-rate test (Abrasive Weight Loss) (%) | 0.47 | — | 0.29 | 0.65 | 0.74 |
| Initial Pad Surface Roughness, $R_a$ (nm) | 827 | 360 | 484 | 748 | 1285 |

Physical Property Measurements:

1. Dynamic Mechanical Analysis

DMA data were measured in accordance with ASTM D5418-05 by a Rheometrics RSAII instrument (manufactured by TA Instruments) with Software Version 6.5.8 using a dual cantilever fixture at a frequency of 10 rad/sec and a strain of 0.2%. The temperature of the sample was ramped at 3° C./min from −100 to 150° C.

The Energy Loss Factor (KEL) was calculated from the E' modulus (in Pascals) and Tan Delta values both measured at 40° C. using the formula:

$$KEL = \tan\delta * 10^{12} / [E' * (1 + \tan^2\delta)]$$

2. Hardness

Hardness (Shore D scale) was measured in accordance with ASTM D2240-05 using a Shore Leverloader with Type D digital scale available from Instron. Measurements were made using a load of 4 kg with a 15 sec. delay.

3. Tensile Properties

Tensile properties (Tensile Strength and Elongation to Break) were measured in accordance with ASTM D412-98a(2002)e1 using an Alliance RT/5 mechanical tester (manufactured by MTS). Specimen geometry used was Type C and cross-head speed was 20 in./min. (50.8 cm/min.).

4. Cut-Rate

The cut-rate or abrasion resistance of the pads was measured in accordance with modified ASTM D1044-05. The abrasion tester used was a Taber Abraser, Model 5150 with Calibrade H22 wheels and a wheel load of 1,000 g. Abrasion resistance was determined by measuring sample weight loss after 1,000 cycles.

5. Surface Roughness

Surface roughness measurements of as received pad surfaces were measured using a Wyko NT8000 Optical Profiling System manufactured by Veeco. The data were measured using a ×50 objective lens with a ×0.55 FOV to give an effective magnification of ×26.1 and an Effective Field of View of 181 by 242 microns. The data were unfiltered and surface roughness was reported as the average surface roughness, $R_a$.

Discussion of Examples

Figure 2:
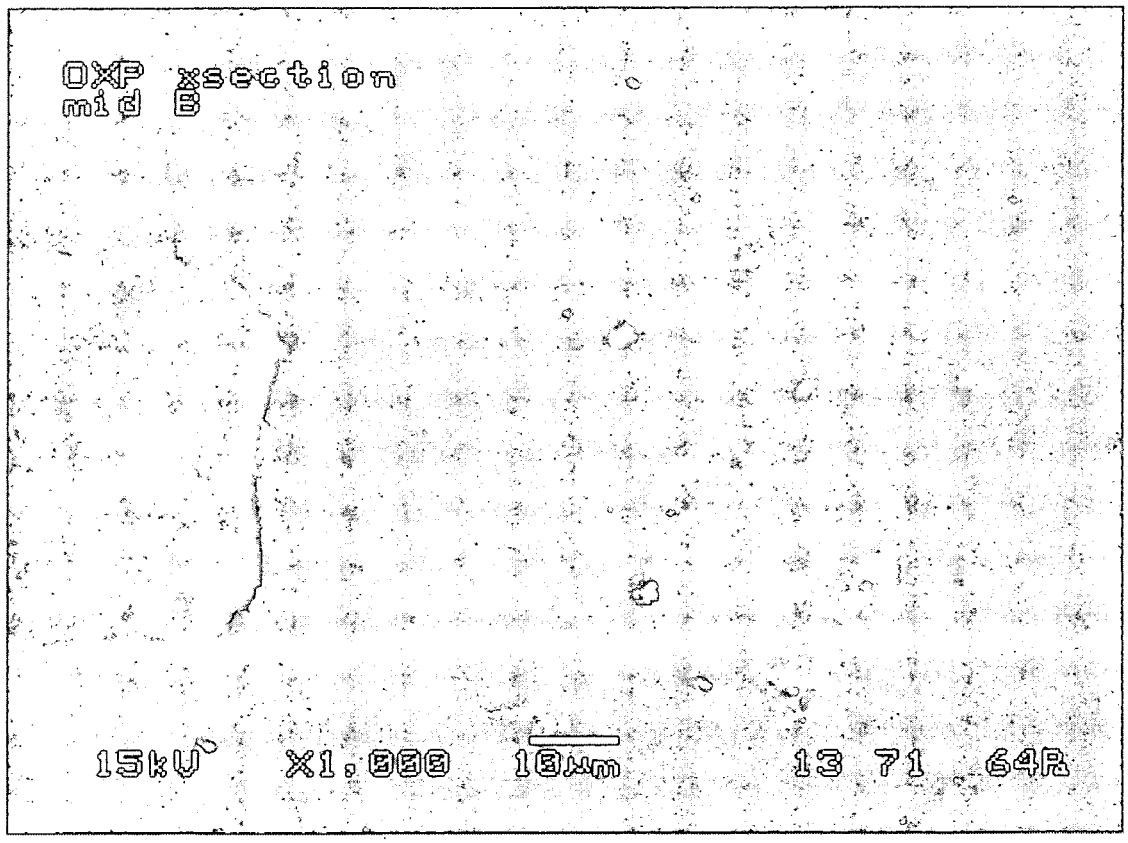
FIGS. 2 to 6 represent scanning electron micrographs of Comparative Examples 1 to 3 and Examples 4 and 5, respectively.
Figure 3:
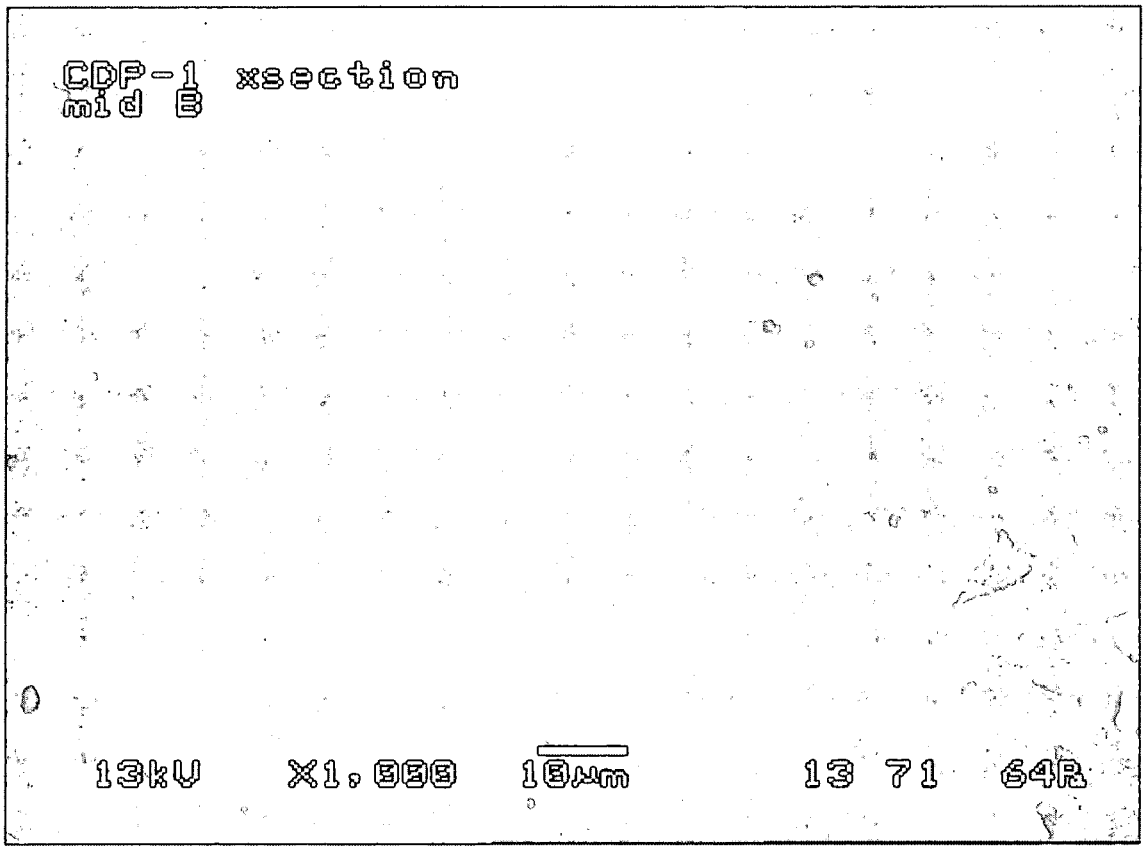

Comparative Examples 1 and 2 represent pads made from the reaction of mixtures of polydiols and polyamines with diphenylmethanediisocyanate (MDI) to form polyurea-urethanes. Although these pads contain both hard and soft segments, the soft segment domains are small and do not have well-defined discrete morphologies. This is apparent from the scanning electron microscope photomicrographs of cross-sections of these pads shown in FIGS. 2 and 3. Apart from debris on the surfaces of the cross-sections, the cross-sections of both prior art Examples 1 and 2 show neither phase separation nor texture at this magnification.

Figure 4:
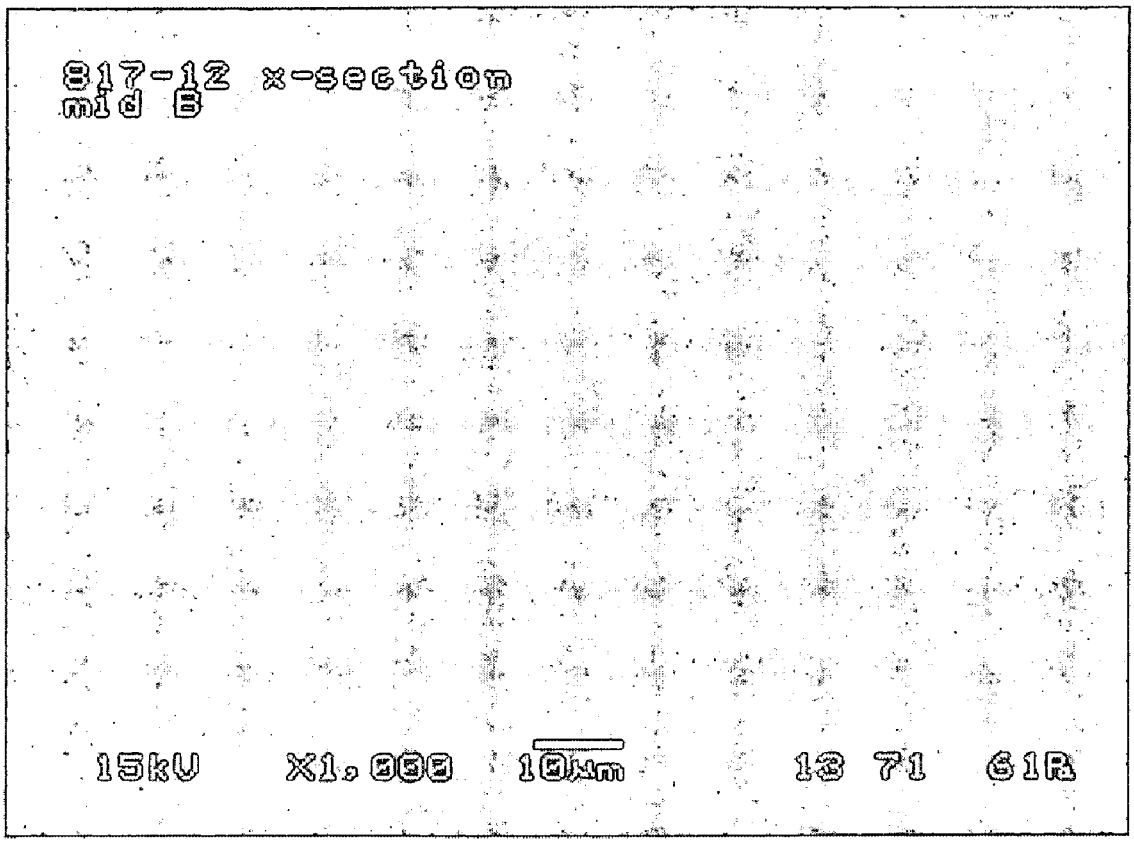

Comparative Example 3 is an experimental polyurea-urethane formulation comprising a soft segment formed from polytetramethylene diol with a glass transition temperature of −62° C. FIG. 4 shows the SEM photomicrograph of a cross-section of this pad. Although more texture is evident than seen in FIGS. 1 and 2, it is apparent that the soft segment domains are very small and ill-defined at this magnification. This degree of phase separation is typical of prior art polyurethanes used for polishing pads.

Figure 5:
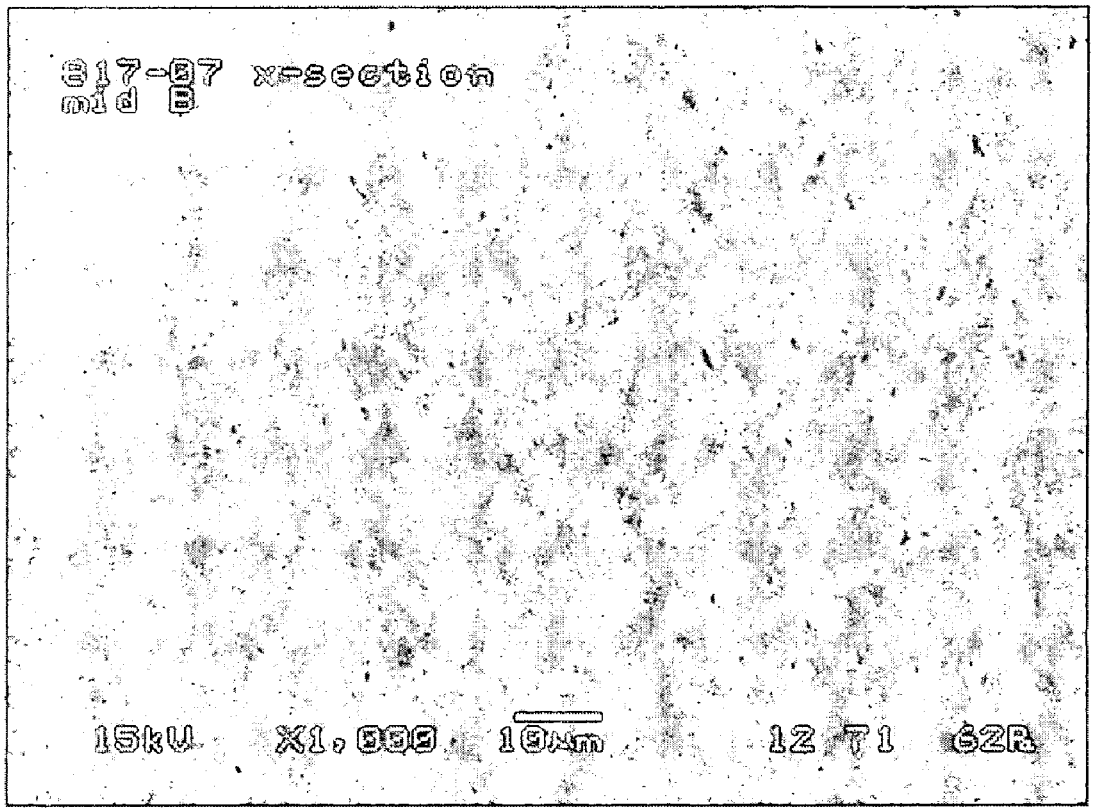
Figure 6:
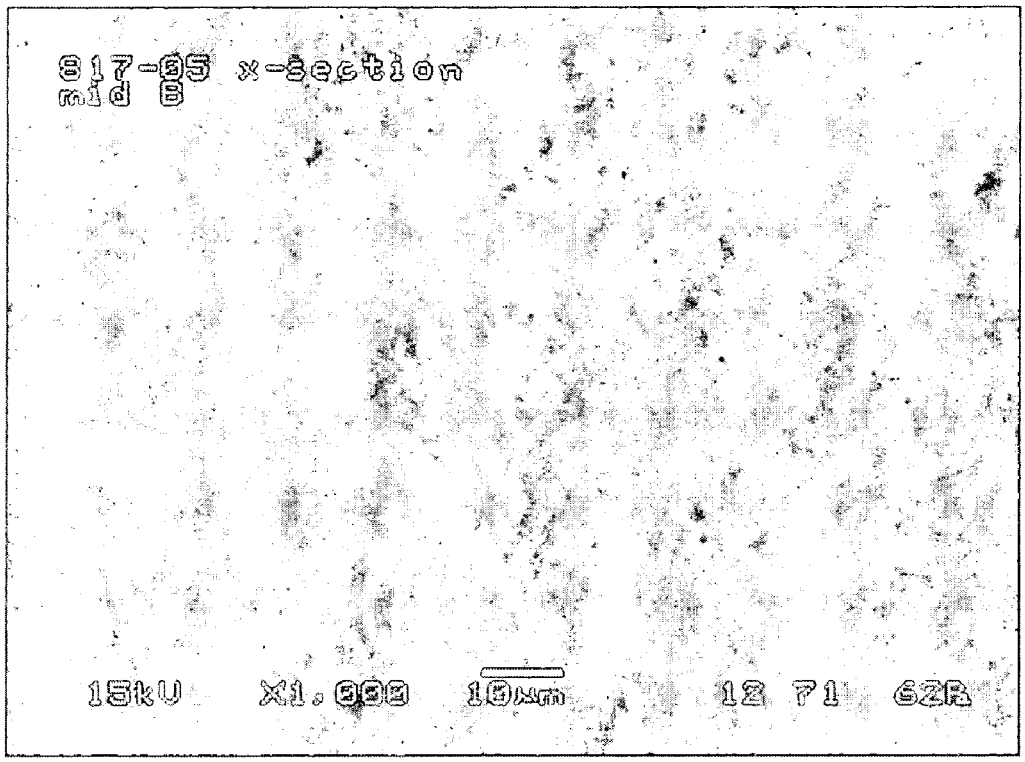

Examples 4 and 5 illustrate the current invention. An elastomeric butadiene-acrylonitrile copolymer containing reactive amine groups and having a glass transition temperature of −59° C. has been added to the formulation of Example 3 and the diisocyanate level adjusted to maintain the correct stoichiometric balance. FIGS. 5 and 6 show comparable SEM photomicrographs for Examples 4 and 5 respectively. It is clear from these photographs that significant phase separation is present and elastomeric domains are observable. The phase separated domains are even more apparent in Example 5 that contains a higher level of elastomer than Example 4.

Thus from the SEM photographs shown in FIGS. 2 to 6, a clear feature of the invention is significant phase separation of the elastomeric domains to a provide a well-defined two phase structure.

Not only is the phase structure observable from SEM photomicrographs of pad cross-sections, but texture is also present in the pad surface. Table 2 compares the surface roughness of the five pad examples. For molded pads, the surface roughness of the pad usually mimics the roughness of the mold surface. Comparing the surfaces of Examples 3, 4 and 5, it can be seen that increasing the level of the elastomeric component significantly increases the roughness of the pad surface over that of the control example (Example 3). The presence of increased texture both at the pad surface and within the bulk of the pad reduces the time required for pad break-in prior to polishing and reduces the need for diamond conditioning during polishing. This results from the pad already having inherent microtexture so not all of the microtexture required for effective polishing must be created by the diamond conditioning process.

The benefits of inherent texture from the elastomeric phase can be quantified using a cut-rate test. Cut-rate is a measure of the ability to diamond condition a pad surface and to create texture. It is measured in terms of abrasive weight loss—the higher the loss the greater the cut-rate. Table 2 shows cut-rate data for Examples 3, 4 and 5. Increasing the level of elastomer clearly increases the cut-rate over control Example 3 and commercial prior art pad Example 1.

For polishing pads, it is desirable to control pad properties over wide ranges. Properties of especial interest are the dynamic mechanical properties of modulus and energy loss, hardness and tensile properties. Ideally, it is desirable to be able to control these independently of one another to achieve the correct balance of properties for optimum polishing performance. This independence is possible in multiphase polymer systems where there are additional degrees of freedom available from manipulation of the properties and morphologies of the different phases present.

This is illustrated in Table 2. Although Examples 3, 4 and 5 have similar moduli and hardnesses, both tensile strength and elongation to break decrease with increasing elastomer content. This translates into the benefit of increased cut-rate without adversely decreasing pad modulus or hardness.

A second aspect of modulus that is technically and commercially important is the dependence of pad modulus on temperature. As polishing temperatures vary from room temperature to approaching 100° C., it is important that the pad properties remain as stable as possible over this range. Pad modulus is particularly important since it determines the pad's ability to control the topography of the wafer. One method to quantify the modulus-temperature is by the ratio of modulus measured at 30° C. and 90° C. A value less than three, preferably less than 2 and ideally as close to unity as possible is preferred for stable polishing performance. Table 2 shows that the value of this ratio is very high for the commercial pad (Example 1) but much lower for Examples 4 and 5. FIG. 7 compares the DMA modulus data for Examples 1 and 4 over the polishing temperature range. Note that the modulus for Example 1 rapidly decreases above 50° C. whereas the modulus of Example 4 is very flat between room temperature and 100° C.

In summary, Examples 4 and 5 are inventive over prior art Examples 1, 2 and 3 as follows:

1. The addition of an elastomeric phase results in greater phase separation that increases cut-rate and reduces break-in time and diamond conditioning during polishing.

2. The presence of an elastomeric phase increases the number of degrees of freedom possible so that pad properties can be varied over wide ranges, can be controlled independently of one other, and can be optimized for specific polishing applications.

3. The elastomeric phase can flatten the modulus over a wide temperature range and provide modulus stability at increased temperatures.

The invention claimed is:

1. A chemical mechanical polishing pad suitable for polishing at least one of semiconductor, optical and magnetic substrates, the polishing pad comprising a polymeric matrix with an elastomeric polymer distributed within the polymeric matrix, the polymeric matrix having a glass transition above room temperature, the polymeric matrix including a polymer derived from difunctional or polyfunctional isocyanates and the polymeric matrix includes at least one selected from polyetherureas, polyisocyanurates, polyurethanes, polyureas, polyurethaneureas, copolymers thereof and mixtures thereof and the elastomeric polymer having a glass transition temperature below room temperature and an average length of at least 0.1 μm in at least one direction, the elastomeric polymer representing 1 to 45 volume percent of polishing pad and the elastic polymer having a glass transition temperature below room temperature, and the polishing pad having an increased diamond conditioner cut rate in comparison to a polishing pad formed from the polymeric matrix without the elastomeric polymer and the cut rate being measured in accordance with ASTM 11044-05 modified to measure weight loss.

2. The polishing pad of claim 1 wherein the elastomeric polymer includes functional groups that bond to the polymeric matrix.

3. The polishing pad of claim 1 wherein the elastomeric polymer has an average length of 0.15 to 100 μm as measured in at least one direction.

4. The polishing pad of claim 1 wherein the elastomeric polymer includes at least one selected from polymers and copolymers derived from butadiene, acrylate, methacrylate, siloxane, or olefinic backbones.

5. The polishing pad of claim 1 wherein the elastomeric polymer is formed in situ.

6. The polishing pad of claim 5 wherein the elastomeric polymer contains at least one of either butadiene-acrylonitrile copolymers or butadiene homopolymers.

* * * * *